United States Patent [19]

Chapman et al.

[11] Patent Number: 4,561,353

[45] Date of Patent: Dec. 31, 1985

[54] ENDLESS BAND HAND STAMP

[75] Inventors: Richard H. Chapman, Mitcham; Bernard Sams, London, both of England

[73] Assignee: Pneumatic Rubber Stamp Co., Ltd., London, England

[21] Appl. No.: 689,784

[22] Filed: Jan. 8, 1985

[30] Foreign Application Priority Data

Jan. 17, 1984 [GB] United Kingdom ..... 84 01165
Jul. 25, 1984 [GB] United Kingdom ..... 84 20215

[51] Int. Cl.[4] ..... B41J 1/20
[52] U.S. Cl. ..... 101/111; 101/405
[58] Field of Search ..... 101/111, 405, 406, 371, 101/372, 373, 105

[56] References Cited

U.S. PATENT DOCUMENTS

| | | | |
|---|---|---|---|
| 794,800 | 7/1905 | Hill | 101/111 |
| 1,247,014 | 11/1917 | Rogers | 101/111 |
| 1,398,363 | 11/1921 | Cressler | 101/111 |
| 2,070,512 | 2/1937 | Corey | 101/111 |
| 2,088,009 | 7/1937 | Melind | 101/111 |
| 2,096,340 | 10/1937 | Richeson | 101/111 |
| 3,164,086 | 1/1965 | Keck | 101/111 |
| 3,338,160 | 8/1967 | Heil | 101/111 X |
| 4,018,157 | 4/1977 | Sato | 101/110 |
| 4,334,470 | 6/1982 | Hamisch, Jr. | 101/105 X |
| 4,492,162 | 1/1985 | Nettesheim et al. | 101/111 X |

FOREIGN PATENT DOCUMENTS

| | | |
|---|---|---|
| 6369 | 11/1878 | Fed. Rep. of Germany . |
| 2300679 | 9/1976 | France . |
| 2330543 | 6/1977 | France . |
| 232116 | 4/1925 | United Kingdom . |
| 262624 | 12/1926 | United Kingdom . |
| 1507140 | 4/1978 | United Kingdom . |

*Primary Examiner*—Clifford D. Crowder
*Attorney, Agent, or Firm*—Walter C. Farley

[57] ABSTRACT

A rubber stamp comprising a housing (13, 14), a base plate (12) fixed at one end of the housing and a handle in the form of a knob (15, 16) mounted at the other end of the housing. A stamp block (24) formed by independently-changeable rubber stamp elements carried by endless rubber bands (25) rotatable in the housing, protrudes through an aperture (23) in the base plate (12). To change the stamp block, the rubber band assembly is withdrawn by axial movement of the knob (15, 16) so as to bring the stamp block within the housing, and the rubber bands are then rotated to set a new stamp block within the housing. Rotation of the rubber bands (25) is effected by respective wheels (31) acting through respective sprocket wheels (56) over which the rubber bands pass. The peripheries of the wheels (31) protrude through slots (33) in a wall of the housing. The slots (33) have recesses (36) through which a part of the periphery of the wheel can be observed carrying information indicating the particular stamp element then forming part of the stamp block.

16 Claims, 5 Drawing Figures

ENDLESS BAND HAND STAMP

The present invention refers to a rubber stamp of the kind comprising a housing, a base plate mounted at one end of the housing and a handle at the other end thereof, and in which a stamp block constituted by a plurality of independently changeable rubber stamp elements projects through an aperture in the base plate, the individual members of the various sets of changeable stamp elements being arranged on respective endless rubber bands rotatably mounted parallel to one another in the housing.

Such stamps are in common use for the date stamping of documents, four sets of stamp elements normally being provided in this case, two to indicate the digits of the day of the month, one the month itself, usually in abbreviated form, and the fourth the year.

The base plate used in this form of date stamp is often required to have permanent rubber stamp elements projecting from the surface thereof, for example, the word "RECEIVED," so that when the date is stamped on a document after the base plate has been brought into contact with an ink pad, the fixed stamp elements will be stamped on the document, together with the date. For the sake of clarity, the present invention will be described with particular reference to such a date stamp, although it will be appreciated that it is equally applicable to other stamps in which the stamp block is required to be changed at intervals, for example a series of individually changeable numbers for stamping numbers in sequence on documents.

It will be appreciated that in order to change the date to be stamped, it is necessary to be able to rotate the various rubber bands so that elements forming the stamp block protruding through the aperture in the base plate will show the date required. To do this, unless one is prepared to use an inconveniently wide aperture which greatly reduces the space available on the base plate for permanent stamp elements, the base plate must be removed in order to free the stamp block from the aperture. Hitherto, this has been done by hinging the base plate to the housing at one side thereof, the base plate normally being held in the closed position by means of a releasable catch at the opposite side thereof. When the date is to be changed, the catch is released, the base plate swung away from the housing and the rubber bands rotated as required in order to produce the desired date at the bottom of the housing where it will protrude through the aperture in the base plate when the latter is closed again. This is a time-consuming and, since at least some of the rubber stamp elements are usually wet with ink, messy business and, moreover, the hinge and the catch are both weak spots in the construction of the stamp and are both liable to break.

It is an object of the present invention to provide a date stamp of the kind referred to above which does not require that the base plate should be removable to effect alteration of the date, but in which changing of the elements of the stamp block can be effected and monitored from outside the housing whilst the base plate remains in the stamping position.

According to the invention, therefore, there is provided a rubber stamp comprising a housing, a base plate mounted at one end of the housing and a handle mounted at the other end thereof, and a stamp block constituted by a plurality of independently changeable stamp elements made of rubber and projecting through an aperture in the base plate, each individual member of the stamp block being one of a set of changeable stamp elements arranged on a respective endless rubber band, said rubber bands being rotatably mounted parallel to one another in said housing, wherein means are provided for withdrawing said stamp block through the aperture in said base plate into the interior of the housing, and for changing the individual elements forming the stamp block within the housing from the outside thereof.

With an arrangement according to the invention, hinging of the base plate for access to the bands is unnecessary and the base plate may be permanently fixed to the housing, thus eliminating a constructional weakness.

Preferably, the changing of the stamp elements is effected by a series of wheels projecting through slots in one wall of the housing, each wheel driving a sprocket fixed to a particular one of the rubber bands so that, when the stamp block has been withdrawn through the aperture in the base plate into the housing, rotation of a wheel will rotate the sprocket and thus the band fixed thereto, so as to change the stamp element of that band. For ease of manual rotation, the peripheries of the wheels may be knurled or notched. Each wheel is provided with indications thereon corresponding to the stamp elements of the band associated with that wheel, the position of these indications being so arranged that a particular indication is visible at the slot through which the wheel protrudes when the corresponding stamp element is positioned to pass through the aperture in the base plate. Means may, if desired, be provided to inhibit rotation of the wheels when the stamp block is in the stamping position.

In order that the stamp block may be moved into and out of the aperture in the base plate, the assembly of rubber bands maybe arranged on a common frame on which they are rotatable, e.g. by the frame being connected to the handle of the stamp and movable therewith in a direction normal to the plane of the base plate. Means are preferably provided for locking the rubber bands in the stamping position after the stamp elements have been set to the required date.

The means connecting the handle to the frame may conveniently incorporate means for adjusting the extent to which the stamp block projects through the aperture in the base plate. Such means may comprise a threaded portion formed on an end of a bar, the other end of which is connected to the frame, and a screw rotatably mounted in the handle, the threaded surface of which mates with the threaded portion on the bar. The screw not only serves to connect the handle with the bar and therefore the frame and the rubber band assembly mounted thereon, but can also be rotated in the handle, thereby causing axial movement of the bar to adjust the position of the stamp block in the aperture in the base plate.

The housing is preferably of a two-part construction, consisting of a first part which is fixed to the base plate, and a second part which is slidable with respect to the first part in a direction towards or away from the base plate and which carries the assembly of rubber bands on which the stamp elements are arranged, so that movement of the second part of the housing moves the stamp block from the aperture in the base plate into the interior of the housing and vice versa.

The handle is preferably in the form of a two-part knob having a body portion mounted on the end of the housing remote from the base plate for limited axial movement with respect to the body, and a separate cap portion which is replaceably mounted on the body portion. Such a construction not only simplifies production and assembly of the rubber stamp, but makes it possible to permit choice of cap colour by a customer.

A preferred form of rubber date stamp according to the invention will now be described with reference to the drawings, in which.

Figure 1:
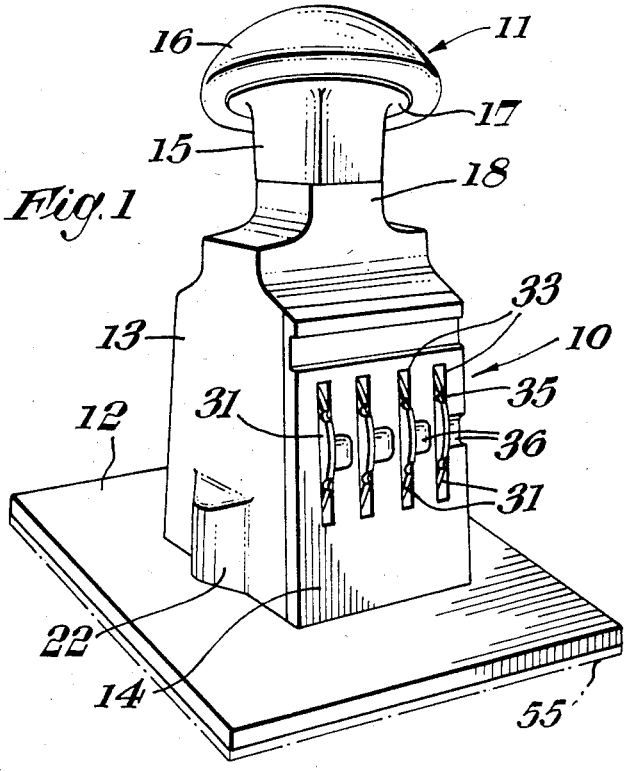
FIG. 1 is a schematic perspective view of a date stamp according to the invention.
Figure 5:
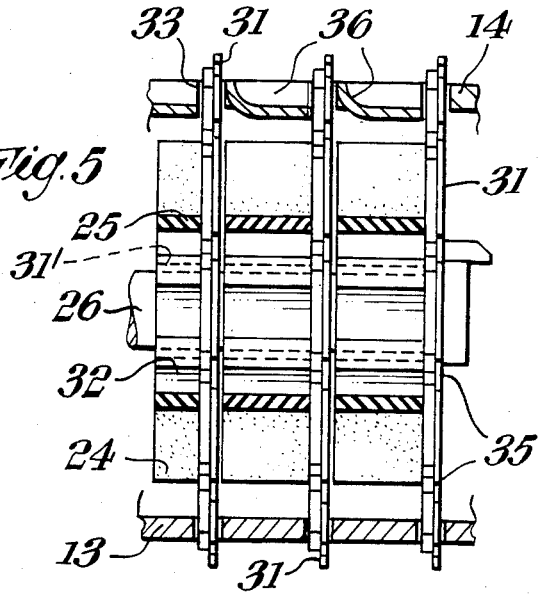
FIG. 5 is a schematic plan view of part of the rubber band and wheel arrangement of the date stamp of FIGS. 1 to 4.
Figure 2:
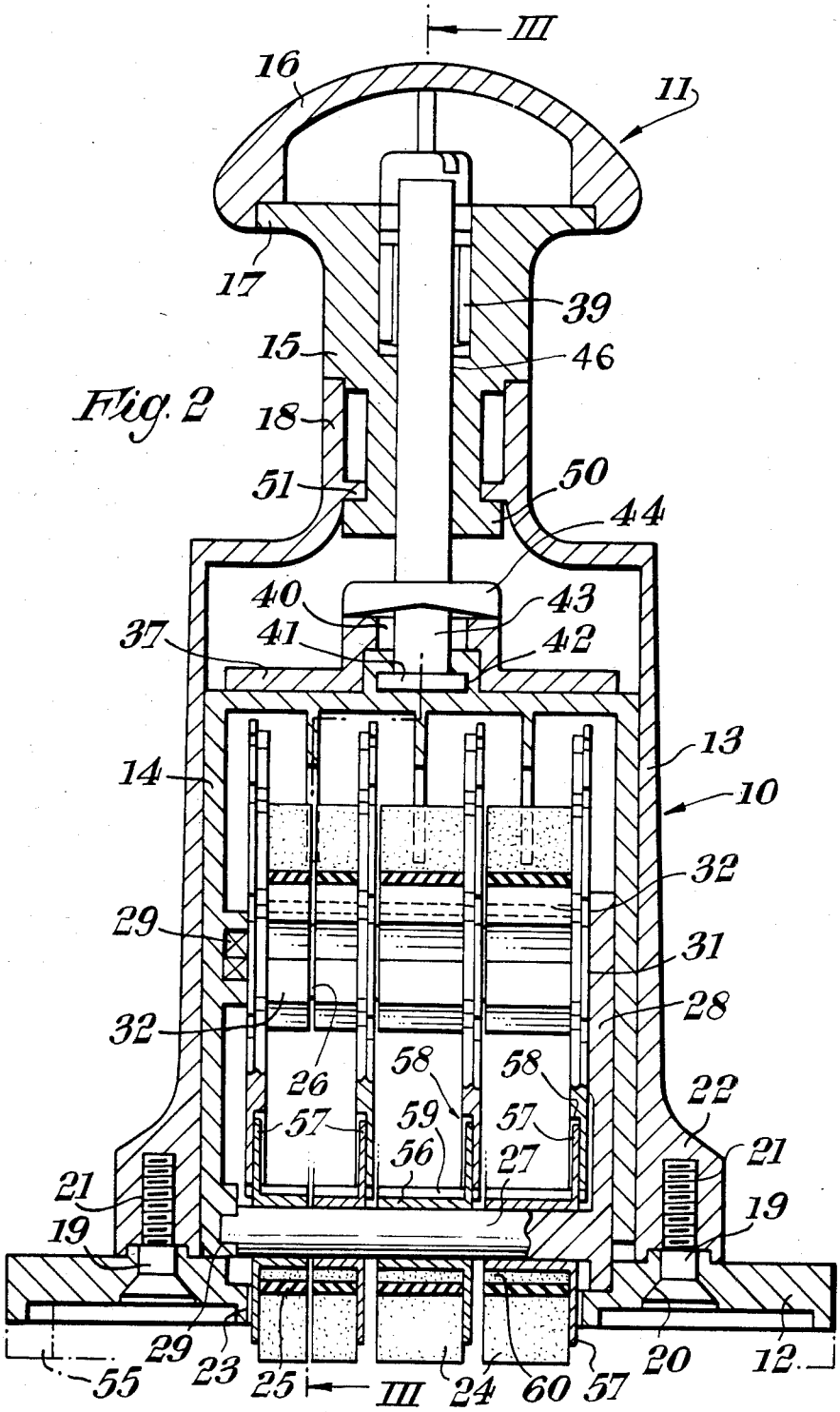
FIG. 2 is a front sectional view of the date stamp of FIG. 1 in the stamping position, taken along the line II—II of FIG. 3.
Figure 3:
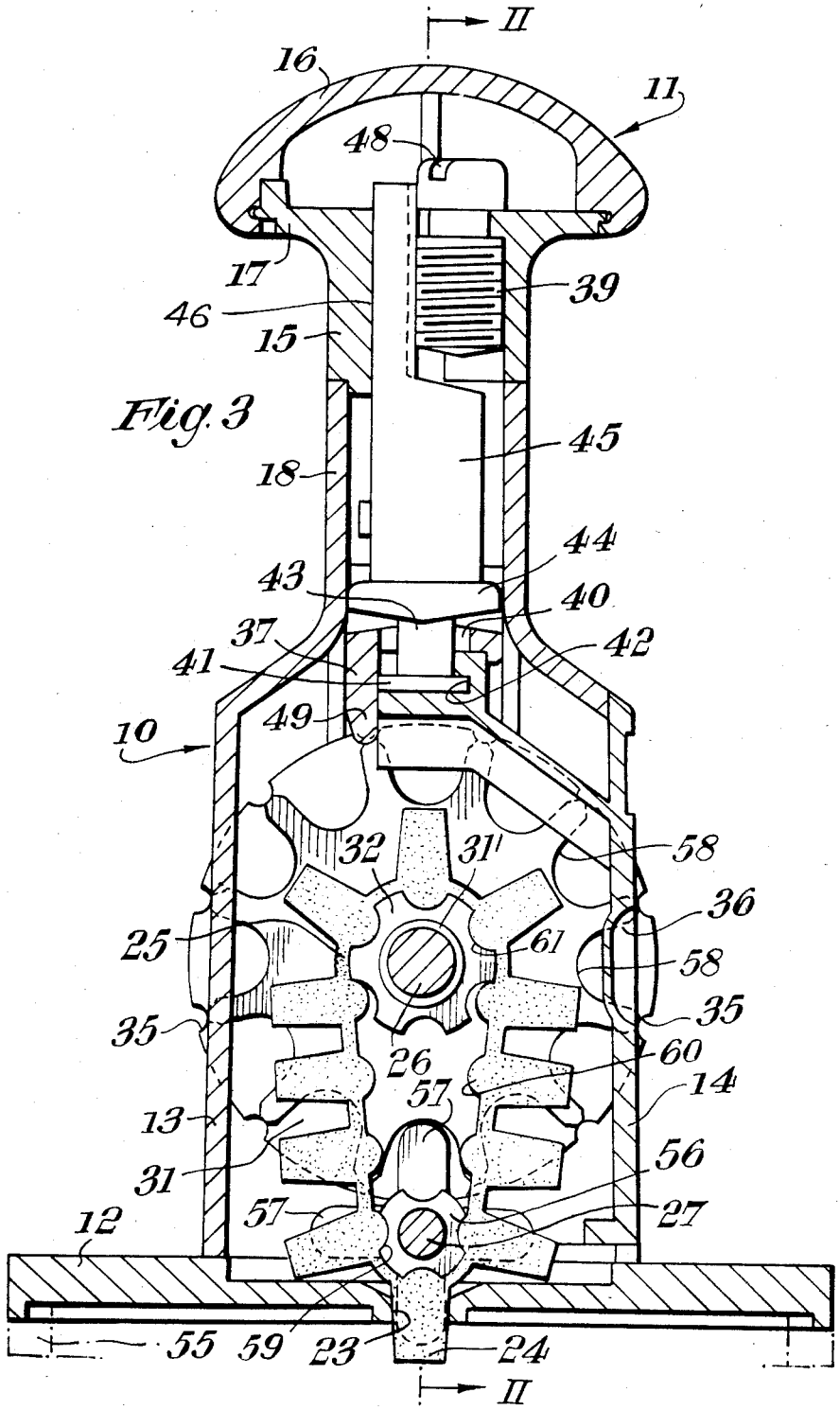
FIG. 3 is a side sectional view of the date stamp taken along the line III—III of FIG. 2.
Figure 4:
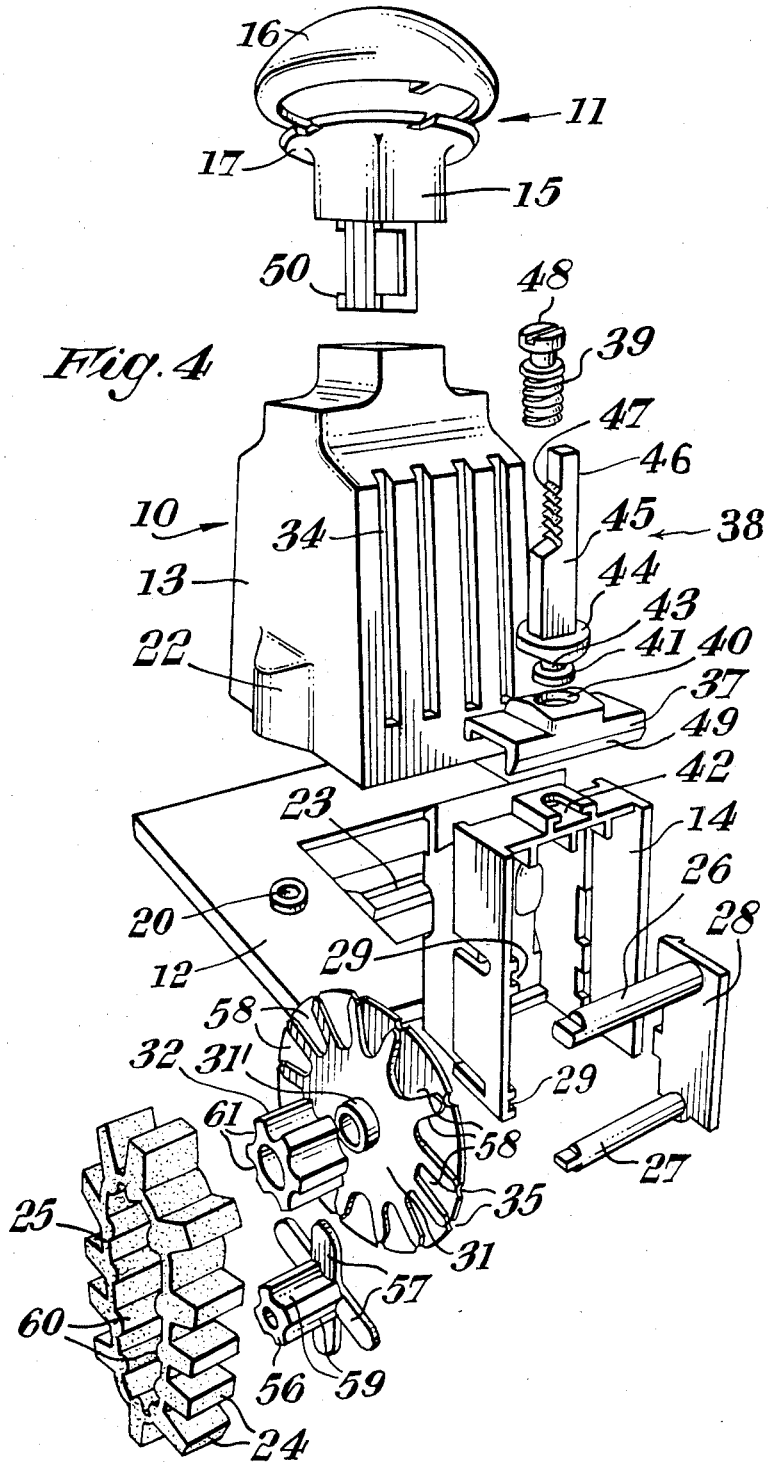
FIG. 4 is a schematic, exploded, perspective view of the date stamp of FIGS. 1 to 3.

Referring to the drawings, the rubber date stamp illustrated comprises a housing indicated generally at 10, a handle in the form of a knob 11 mounted at one end of the housing, and a base plate 12 located at and fixed to the other end of the housing. The base plate 12 is made of a reinforced plastics material, for example, a glass-fibre reinforced polycarbonate material, or an A.B.S. resin.

The housing 10 consists of two parts, a main part 13, which is closed on three sides, and a front part 14, which closes the open side of the main part 13 and is slidable within it. The parts 13 and 14 are preferably plastics mouldings, e.g. of an A B S resin. The knob 11 is formed in two parts, a generally cylindrical body portion 15 and a separate cap portion 16 which is a push fit over a peripheral flange 17 at the upper end of the body portion 15. The other end of the body portion 15 is fitted in the upper end of a neck portion 18 upstanding from the top of the main part 13 of the housing.

The base plate 12 is fixed to the bottom of the main part 13 of the housing from below by means of screws 19 passing through countersunk holes 20 and engaging in threaded holes 21 in projections 22 formed on either side of the main part 13.

The base plate 12 is provided with an aperture 23 through which protrudes a stamp block 24 consisting of four stamp elements indicating the two digits of the day, the month and the year respectively of the date. Separate sets of stamp elements are each carried on four endless rubber bands 25, so that each of the elements can be individually changed when the stamp block has been withdrawn from the aperture 23 into the interior of the housing. The base plate will usually also be provided with one or more permanent rubber printing dies, indicated at 55 e.g. a border, and/or the word "RECEIVED".

The rubber bands 25 are mounted on a frame consisting of an upper rod 26 and a lower rod 27. The rod 26 and rod 27 are held in parallel spaced relationship at one side by a flat side piece 29 and the free ends of the rod 26 and the rod 27 are flattened so as to slide within grooves 29 formed in one inner side wall of the front housing part 14, the outer face of the flat side piece 28 then sliding over the opposite inner side face of the front part 14, so that the frame can be clipped into the front part 14.

Each of the rubber bands 25 is provided with a respective changing wheel 31, having a protruding central portion 31' carrying an idler wheel 32 over which the band runs, and which rotates freely on the upper rod 26. The actual rotation of the rubber band is effected by a respective sprocket wheel 56 which has four projections 57 at one end thereof extending at 90° to one another and which revolves freely on the lower rod 27. The width of the idler wheel 32 and the sprocket wheel 56 are the same and at least approximately correspond to the width of the rubber band with which the particular sprocket and idler wheels are associated. The face of the wheel 31 from which the idler wheel 32 projects is provided with recesses 58, equal in number to the number of stamp elements on the associated band. For the date stamp illustrated in the drawings, each rubber band has twelve stamp elements, and each wheel consequently has twelve recesses 58. The wheel 31 has a diameter such that as it turns about the upper rod 26, the recesses 58 will engage sequentially with the projections 57 of the sprocket wheel 56 to move the band on to change the date. Since there are twelve recesses 58 and four projections 57, a movement of the wheel 31 through 30° will move the sprocket through 90° to change the date. The sprocket wheel is keyed to the rubber band by four recesses 59 in the periphery of the sprocket wheel which receive corresponding shaped lugs 60 formed on the inner face of the rubber band 25. Similar recesses 61 are provided on the perimeter of the idler wheel. The wheels 31 are arranged next to one another for rotation on the rod 26 of the frame, and the sprocket wheels 56 are correspondingly arranged on the rod 27. In the front part 14 of the housing, slots 33 are provided through which the peripheries of the wheels 31 extend, so that the wheels can be rotated manually from outside the housing. The opposite sides of the wheels 31 project through corresponding slots 34 in the main part 13 of the housing. These slots must be of sufficient length to allow for movement of the wheels 31 when the frame carrying the bands 25 is raised and lowered and the stamp lifted out of or lowered into the recess as will hereinafter be described. The periphery of each wheel is provided with spaced recesses 35, which serve to hold the wheels against rotation when the stamp block has been set and is in the stamping position, as will hereinafter be described. The projections 57 which at any setting of the rubber band 25 project into the aperture 23, also serve to prevent rotation of the rubber bands when the date has been set. The front part 14 is provided adjacent to each slot with a recess 36 which exposes a portion of the peripheral area of the face of the respective wheel 31 within a recess 58, so that a marking on this face of the wheel is visible which corresponds to, and thus indicates, the element of the respective rubber band which at that time forms part of the stamp block protruding through the aperture 23 in the base plate. The appropriate markings for such indication are spaced round the peripheral part of the face of each wheel within the respective recesses 58.

The body portion 15 of the knob 11 is of generally hollow cylindrical form and is connected to the top of the front part 14 of the housing by means of an arrangement comprising a frame saddle 37, a frame adjuster 38 and a frame adjuster screw 39. The frame saddle 37 fits over the top of the front part 14 of the housing and at the top thereof has a hole 40 through which passes an end flange 41 at the lower end of the frame adjuster 38. This end flange 41 is held in a grooved recess 42 on the top of the front portion 14. The remainder of the frame adjuster comprises a cylindrical portion 43, an intermediate flange 44, the lower surface of which forms a cam, and an upper blade portion 45, the upper part 46 of which is cut away to receive the frame adjuster screw 39, the inner surface 47 of the cut-away part 46 having a screw thread which mates with an external screw thread on the frame adjuster screw 39. The top of the latter has a groove 48 to receive a screwdriver blade for adjustment purposes. The cut-away part 46 of the frame adjuster and the frame adjuster screw 39 are housed in the body portion 15 of the knob, so that the thread of the screw 39 meshes with the thread on the inner surface 47.

One side wall 49 of the frame saddle 37 extends downwardly so that its end will engage in one of the recesses 35 on the peripheries of the wheels 31, so as to lock the wheel after the date is set, as will hereinafter be described.

The lower end of the body portion of the knob 11 is provided with lateral projections 50 which latch under projections 51 on the inner wall of the neck portion 18, to lock the knob when the stamp is in the working (stamping) condition, but can be freed by turning the knob through 90° when the knob carrying with it the front portion 14 can be moved upwardly.

In order to assemble and set the rubber stamp, the adjusting wheels 31 and idler wheels 32, are assembled on the upper rod 26 of the frame and the sprocket wheels 56 on the lower rod 27 thereof with the rubber bands 25 positioned over the respective idler and sprocket wheels, and the frame is then snapped into the front part 14 of the housing. The end flange 41 of the frame adjuster 38 is passed through the hole 40 in the frame saddle 37 and slid into the groove 42 at the top of the front part 14 to hold these parts together. The frame adjuster screw 39 is placed in position in the body portion 15 of the knob. The front part 14 carrying the frame assembly is moved up through the main part 13 of the housing, and the body portion 15 of the knob is pushed into the top of the neck portion 18 until the frame adjuster screw 39 engages with the mating screw in the surface 47 of the frame arrester; the screw 39 is then tightened to hold the unit together. The frame and band assembly are then locked by turning the knob clockwise through 90°, so that the projections 50 on the body portion 15 are locked beneath the projections 51 on the inner wall of the neck portion.

The base plate 12 is then secured to the bottom of the main part 13 of the housing, the stamp block 24 passing through the aperture 23.

The height of the printing face of the stamp block is then adjusted by adjustment of the frame adjuster screw 39 to raise or lower the frame adjuster 38 and therefore the frame assembly and the stamp block, so as to bring the printing face of the stamp block into alignment with the face of any permanent rubber printing die fitted to the base plate. Once adjusted correctly to this height, it should not normally be necessary to readjust the height unless a new rubber die of different thickness is fitted to the base plate in place of the original die.

Finally the knob cap 16 is press fitted on to the body portion 15 of the knob.

In order to set a particular date on the stamp block, the frame assembly is unlocked by rotating the knob anticlockwise through 90° so that the projections 50 are brought out of locking engagement with the projections 51. The knob can now be pulled upwards so that the stamp block is lifted out of the recess in the base plate. At the same time, owing to the cammed shaping of the lower faces of the intermediate flange 44 on the frame adjuster 38, the end of the side wall 49 of the frame saddle 37 is no longer locked in the recesses 35 in the wheels 31, so that the wheels can be rotated against only a slight resistance offered by the frame saddle 37, which has a click-stop effect and assists in exact location of the individual elements of the stamp block. The day, month and year are now set by rotation of the wheels 31 which directly drive the sprocket wheels 56 to rotate the bands 25, the date set being indicated by the markings appearing in the recesses 36. The knob is then pushed down so that stamp block enters and passes through the aperture in the base plate, and the stamp is locked in the working position by rotating the knob clockwise through 90° so that the projections 50 again engage under the projections 51 and the shape of the cam surface of the intermediate flange 44 of the frame adjuster forces the end of the wall 49 into locking engagement with the appropriate recesses 36 to lock the adjusting wheels against rotation. The insertion of the projections 57 into the aperture 23 also has a locking effect as previously described. The stamp is then ready for use.

The use of a two-part operating knob with a separate cap portion enables colour selection of the cap by a purchaser, or replacement of one cap by another of a different colour.

In general, all the components of the stamp can be made of suitable plastics material, if necessary containing a suitable filler for strength. As an example, the frame adjuster 38, the frame saddle 37, and the front part 14 of the housing may be made of an acetal resin containing a suitable filler. The knob 11 may likewise be made of acetal resin with the cap 16 of an A.B.S. material. The main part 13 of the housing may be made of toughened A.B.S. or the mixture of A.B.S. and polycarbonate resin sold under the Trade Name "Bayblend". The frame 26, 27, 28 may be made of glass fibre-filled nylon or acetal resin. The wheels 31 may also be made of acetal resin, e.g. a light-coloured acetal resin with the printing thereon in black. Finally, as previously stated, the base plate 12 may be made of glass fibre-reinforced polycarbonate or A.B.S. material.

It will, of course, be appreciated that the materials mentioned above are only given as examples of suitable materials of construction of the various elements of the rubber stamp of the invention, and other suitable plastics materials may be used. It is also possible, if desired to make at least some of the components, for example, the base plate and the housing parts, of metal.

If desired, for strength, the rubber bands carrying the stamp elements, may in each case be vulcanised on to a fabric strip at their inner periphery, e.g. a strip of woven polyester fabric, or they can be injection moulded from a suitable material.

While a preferred embodiment of the invention is illustrated in the drawings and has been described in detail above, it will be apparent to those skilled in the art that many modifications of the structure illustrated are possible. Thus for example, a three-piece construction may be used for the housing, comprising a central U-shaped portion which is fixed to the base plate at its open end by suitable flanges and at the other end has a neck portion to receive the operating knob, and two side portions closing the open sides of the U, one of which carries the frame and the operating wheels and rubber bands and is slidable with respect to the central U-shaped portion.

Again, if desired, the operating knob may have a one-piece construction. Other methods of adjusting the height of the stamp block in the base plate can also be used in place of the threaded surface 47 and the screw 39; for example, a shaft connected at its lower end to the frame carrying the rubber bands can be adjustably fixed to the knob by means of a screw.

While the term "rubber" has been used in the description and is used in the appended Claims, in respect of the material used for the stamp elements and the bands on which they are mounted, this term is not intended to be limited to natural rubber, but to cover any suitable natural or synthethic elastomer or mixture thereof.

We claim:

1. A rubber stamp comprising a housing a base plate fixedly attached to one end of said housing and having an aperture therethrough;

a handle mounted at the other end of said housing;

a stamp block including:

a plurality of independently changeable stamp elements made of rubber and projecting through an said aperture in said plate, said stamp elements being arranged on a plurality of endless rubber bands rotatably mounted parallel with each other on a common frame in said housing, said common frame being connected to said handle for movement therewith in a direction normal to said base plate;

means for withdrawing said stamp block through said aperture in said base plate into the interior of said housing;

means for changing said stamp elements on said stamp block within said housing from outside thereof, said means for changing comprising a plurality of wheels projecting through respective slots in a wall of said housing, each said wheel having a plurality of peripheral recesses and being rotatable to rotate one of said rubber bands; and means for locking each said wheel against rotation when said stamp block is in the stamping position, said means for locking including a frame saddle loosely carried on said frame and having a projection thereon, and cam means carried by said handle for moving said projection into engagement with a peripheral recess on each of said wheels when said handle is rotated through a predetermined angle.

2. A rubber stamp according to claim 1 and further comprising interengaging means on said handle and said housing for locking said handle to said housing when said handle is rotated to lock said wheels.

3. A rubber stamp according to claim 2 wherein said locking means includes a projection on said handle and a corresponding projection on said housing.

4. A rubber stamp assembly comprising the combination of a base plate having an opening;

a stamp block including:

a plurality of individually adjustable elastomeric bands each having a plurality of stamp elements thereon, wheel means for carrying and longitudinally adjusting said bands, and means for mounting said stamp block to be movable between a stamping position in which selected elements extend through said opening and a retracted position in which said bands can be adjusted; and a housing substantially enclosing said stamp block, said housing having openings through which adjustment portions of said wheel means extend, said base plate being fixedly attached to one end of said housing;

said means for mounting comprising a handle at the other end of said housing from said plate, said handle having a portion extending into said housing and coupled to said stamp block, and latch means on said handle for engaging and latching said handle and said block to said housing when said block is in said stamping position, said latch means being disengagable from said housing for axial movement away from said plate by rotating said handle through a predetermined angle.

5. An assembly according to claim 4 wherein said wheel means includes:

upper and lower sprockets around which said bands extend, said lower sprockets being adjacent said base plate opening and said upper sprockets being coaxial with said adjustment portions of said wheel means extending through said housing openings, each said adjustment portion having a plurality of recesses thereon equal in number to the number of elements on the associated one of said bands; and a plurality of radial projections on each of said lower sprockets meshing with said recesses on said adjustment portion such that rotation of said adjustment portion rotates said lower sprocket when said block is in the retracted position, at least one of said radial projections extending into said base plate opening to lock said lower sprocket against rotation when said frame is in the stamping position.

6. A rubber stamp as claimed in claim 4, wherein withdrawal of said stamp block into said housing is effected by movement of said handle away from said base plate in a direction normal thereto.

7. A rubber stamp as claimed in claim 6, wherein said rubber bands are mounted for rotation on a common frame connected to said handle for movement therewith in a direction normal to said base plate.

8. A rubber stamp as claimed in claim 7, and including means for adjusting the extent to which said stamp block projects through said aperture.

9. A rubber stamp as claimed in claim 8, wherein said adjusting means comprises a threaded portion on an end of a bar, the other end of which is connected to said frame, which portion mates with a screw rotatable in said handle to adjust the axial position of said bar with respect thereto.

10. A rubber stamp as claimed in claim 4, wherein said wheel means includes a plurality of wheels projecting through respective slots in a wall of said housing, each said wheel being arranged on rotation to rotate a respective one of said rubber bands.

11. A rubber stamp as claimed in claim 10, wherein each said wheel means is provided with a respective idler wheel and a respective sprocket wheel spaced therefrom, the rubber band associated with said wheel running around said sprocket and idler wheels, and said wheel being provided with peripheral recesses therein which on rotation are arranged to mesh with projections on said sprocket wheel to rotate the latter and therewith said rubber band.

12. A rubber stamp as claimed in claim 11, wherein each said sprocket is provided with peripheral recesses to receive correspondingly-shaped lugs spaced on the inner surface of the associated rubber band.

13. A rubber stamp as claimed in claim 10, wherein each said wheel is provided with indications thereon corresponding to the stamp elements of the rubber band associated with said wheel, the indications corresponding to the stamp elements forming the stamp block at any time being visible from outside the housing.

14. A rubber stamp as claimed in claim 13, wherein each said indications are visible at respective recesses in said wall of the housing adjacent to said slots.

15. A rubber stamp as claimed in claim 4, wherein said housing is of two-part construction, comprising a first part fixed to said base plate and a second part slidable with respect to said first part towards or away from the base plate and carrying the assembly of rubber bands on which the stamp elements are arranged.

16. A rubber stamp as claimed in claim 4, wherein said handle is in the form of a two-part knob having a body portion mounted on the end of said housing remote from said base plate for limited axial movement with respect thereto, and a cap portion removably mounted on said body portion.

* * * * *